US005934151A

United States Patent [19]

Carr et al.

[11] Patent Number: 5,934,151

[45] Date of Patent: Aug. 10, 1999

[54] VEHICLE PUSH ROD AND PEDAL ASSEMBLY

[75] Inventors: James Eugene Carr, Waterford; James Donald Walden, Wolverine Lake; Leonid Drits, West Bloomfield, all of Mich.

[73] Assignee: General Motors Corporation, Detroit, Mich.

[21] Appl. No.: 08/844,035

[22] Filed: Apr. 18, 1997

[51] Int. Cl.[6] ..... G05G 1/14

[52] U.S. Cl. ..... 74/512; 74/560; 403/12

[58] Field of Search ..... 74/560, 512, 579 R; 403/11, 12, 19, 327, DIG. 7

[56] References Cited

U.S. PATENT DOCUMENTS

| | | | |
|---|---|---|---|
| 1,939,221 | 12/1933 | Nelson | 74/512 |
| 3,052,130 | 9/1962 | Kellogg et al. | 74/512 X |
| 3,766,802 | 10/1973 | Shellhause | 74/512 |
| 5,533,421 | 7/1996 | Damerow et al. | 74/560 X |

FOREIGN PATENT DOCUMENTS

| | | | |
|---|---|---|---|
| 3203235 | 8/1983 | Germany | 74/512 |
| 550138 | 12/1942 | United Kingdom | 74/560 |
| 2244324 | 11/1991 | United Kingdom | 74/512 |

OTHER PUBLICATIONS

General Motors Corporation, Clutch Master Cylinder to clutch pedal, 1996 C/K Truck.

*Primary Examiner*—John A. Jeffery
*Assistant Examiner*—Mary Ann Battista
*Attorney, Agent, or Firm*—Kathryn A. Marra

[57] ABSTRACT

A push rod and pedal assembly includes a pedal pivotally mounted on a vehicle for movement in a generally longitudinal direction and a socket portion mounted on the pedal and movable with the pedal. The socket portion preferably has an opening facing in a generally forward longitudinal direction. The push rod and pedal assembly further includes a longitudinally oriented push rod having a push rod end being alignable generally forward of the socket portion and insertable within the socket portion upon forward longitudinal movement of the pedal. Thus, the push rod end becomes coupled to the socket portion of the pedal upon the application of forward longitudinal movement to the pedal, such as by a foot of an assembler. Preferably, a retainer is mounted on the push rod end and the retainer and push rod end are insertable within the socket portion of the pedal by snap-fitted connection upon forward longitudinal movement of the pedal.

4 Claims, 4 Drawing Sheets

FIG 1
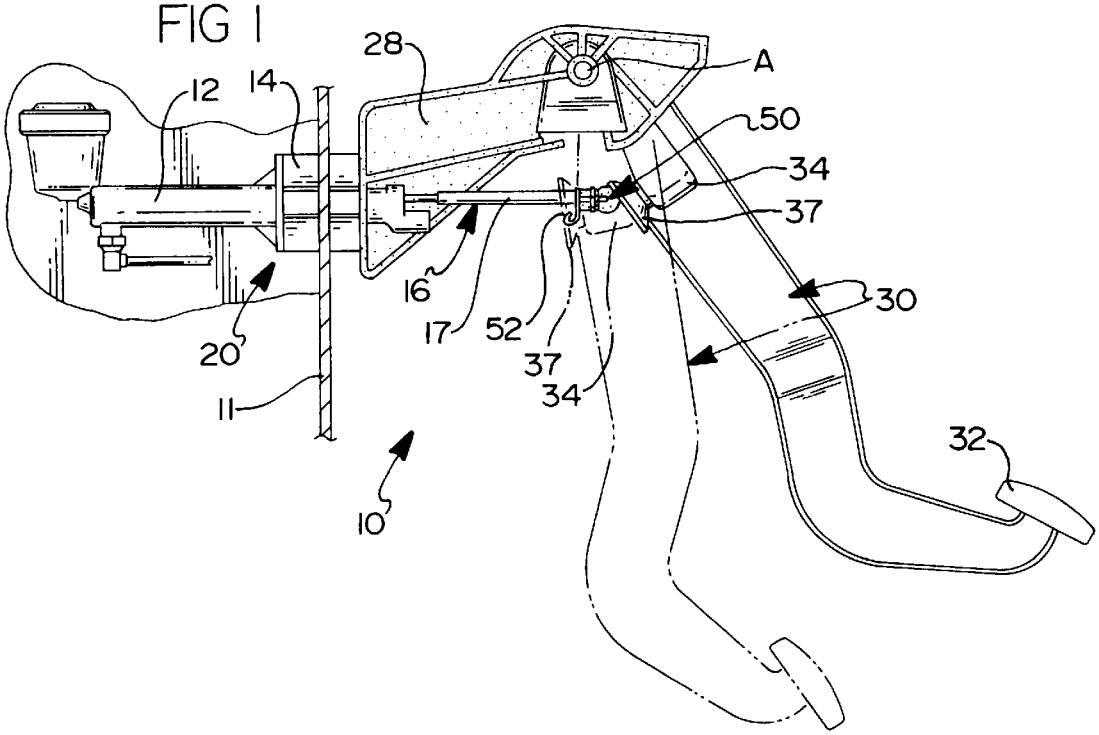
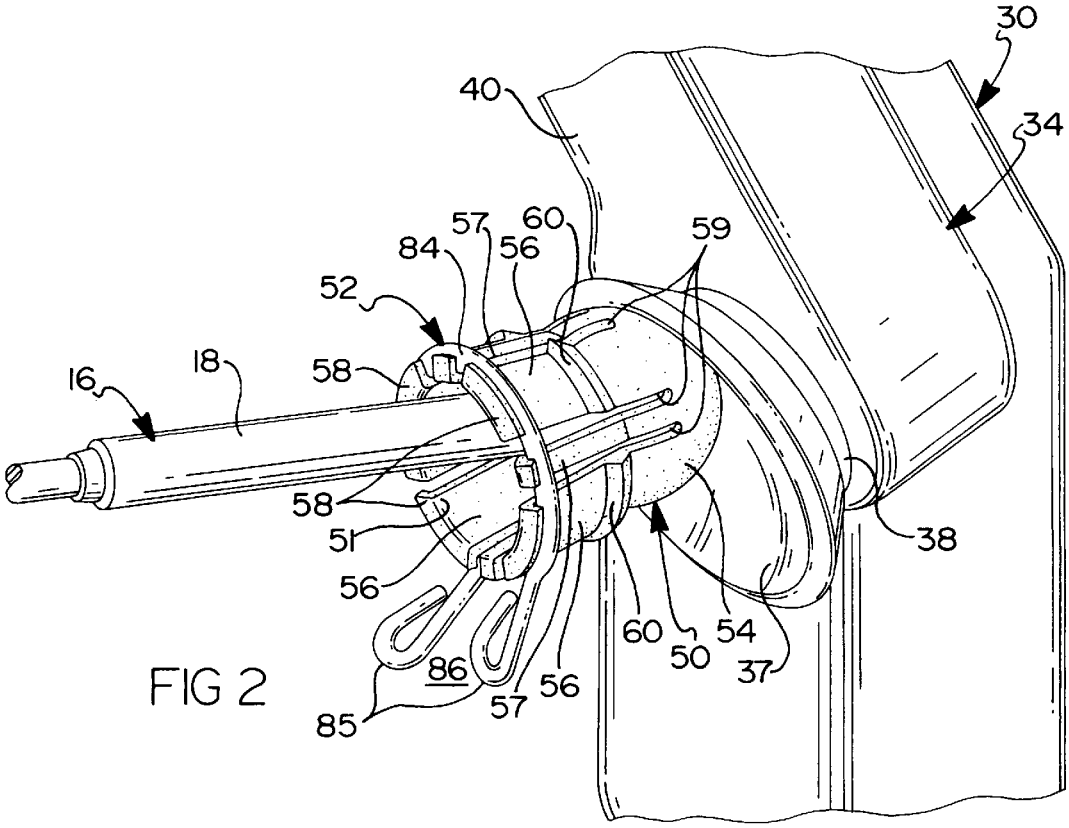
FIG 2

FIG 3
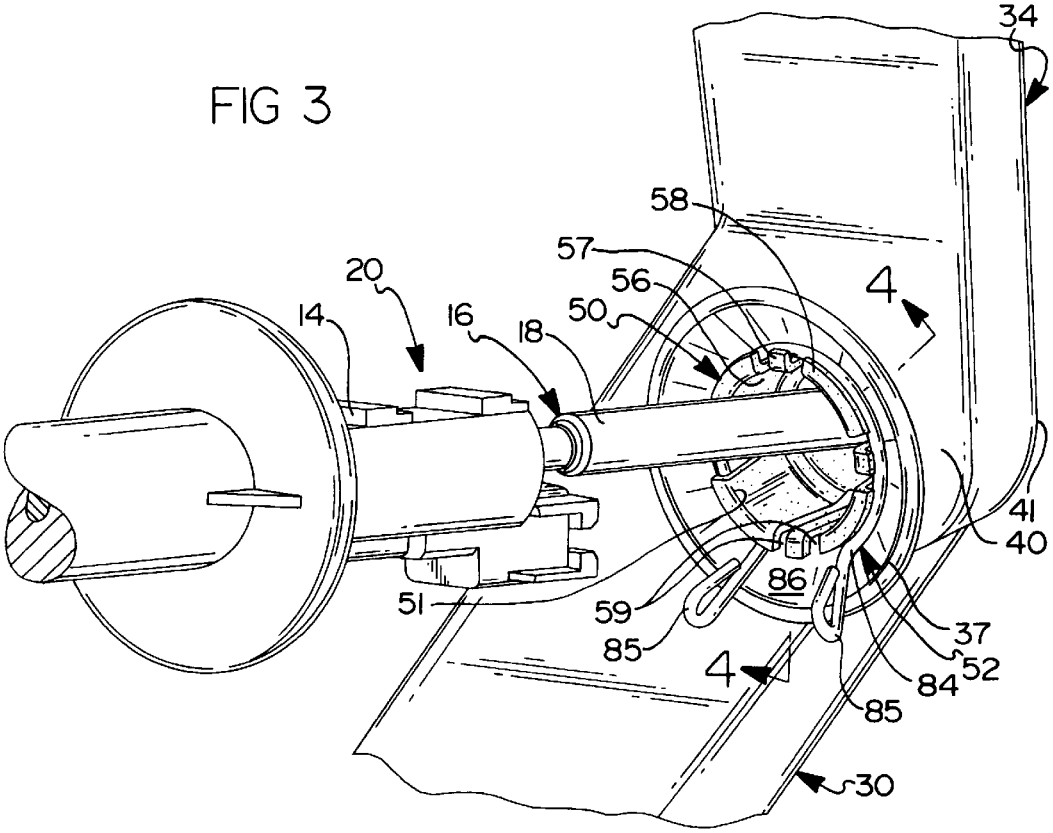
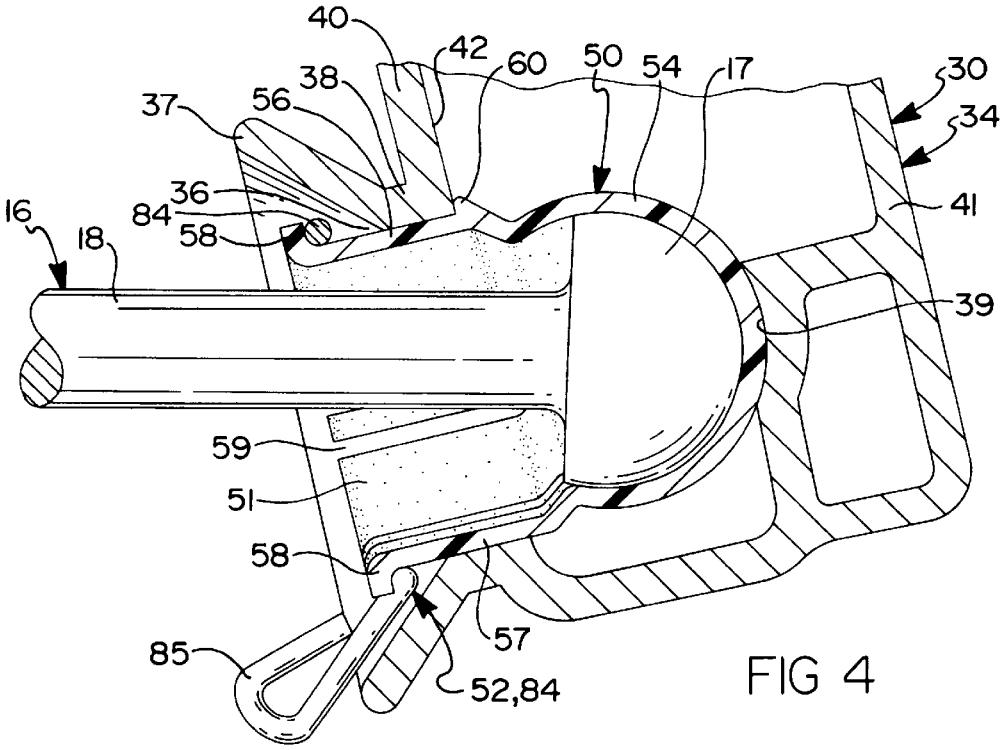
FIG 4

FIG 5
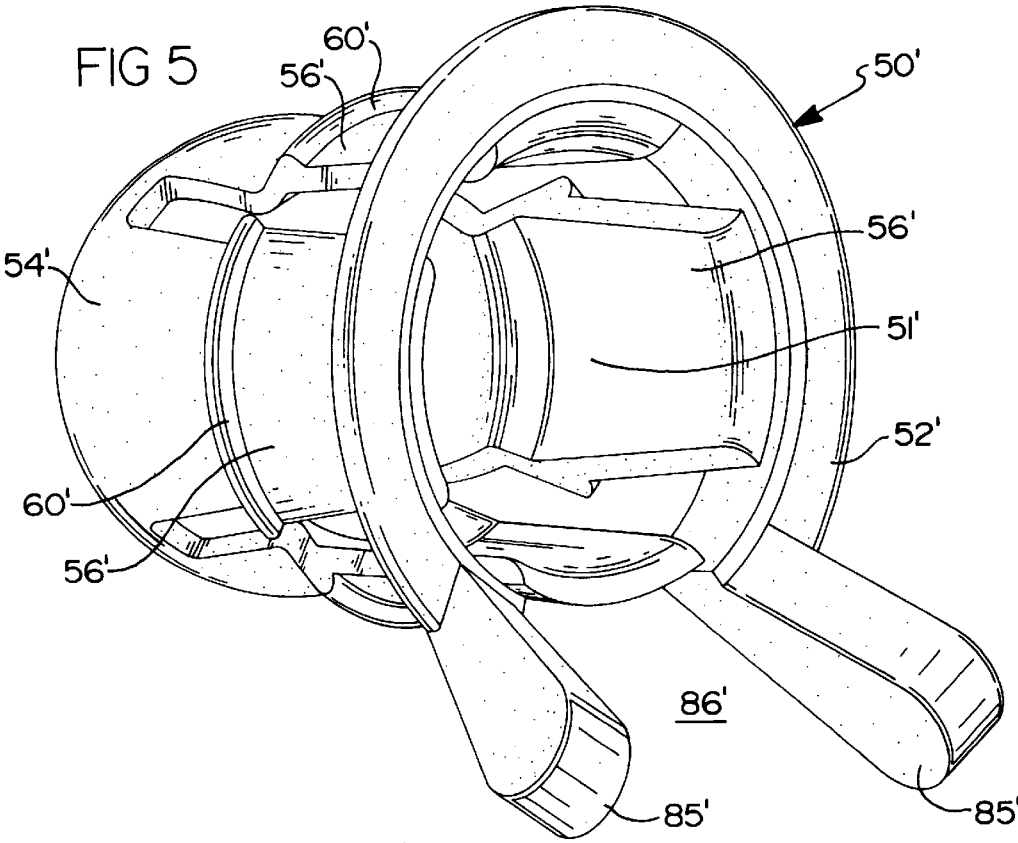
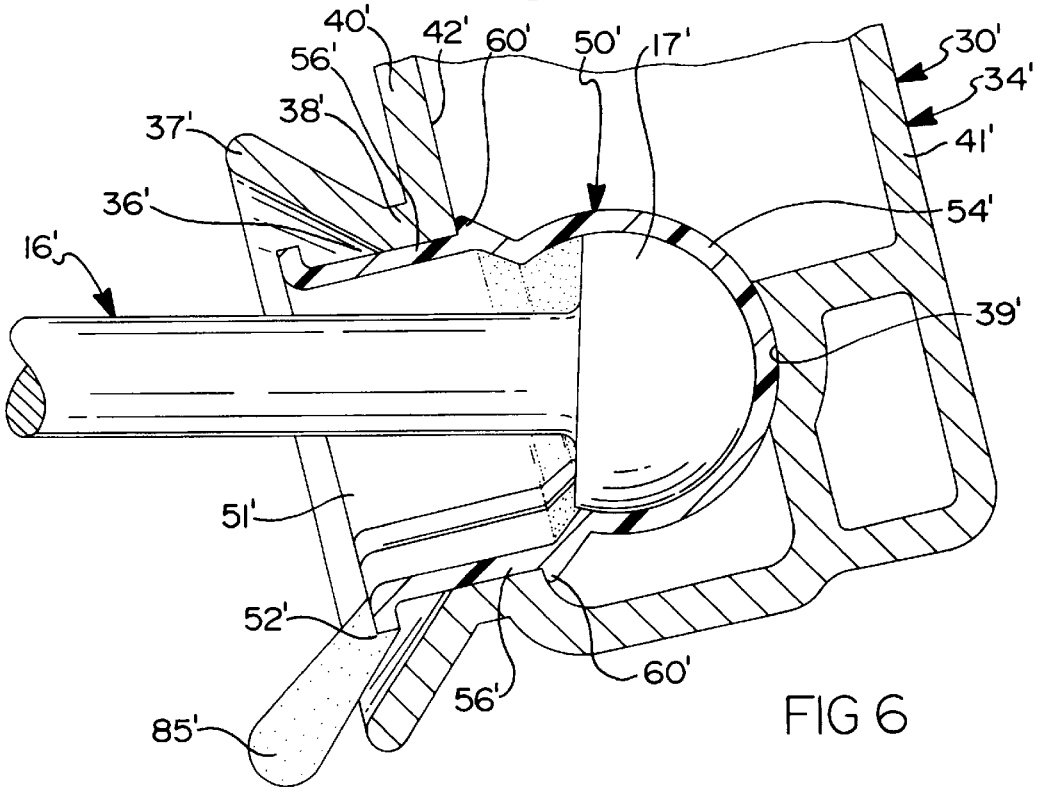
FIG 6

VEHICLE PUSH ROD AND PEDAL ASSEMBLY

TECHNICAL FIELD

This invention relates to a push rod and pedal assembly in a vehicle, and more particularly to a push rod and pedal assembly which permits easy assembly and disassembly.

BACKGROUND OF THE INVENTION

It is well known in the prior art to provide a vehicle including a foot pedal assembly which is mounted to a lower dash portion of the vehicle forward of a vehicle driver. The pedal is typically pivotally mounted to the vehicle for operation by the foot of a vehicle driver. The pedal is typically connected to a mechanically or hydraulically operated mechanism such as a clutch mechanism or a brake mechanism. To accomplish actuation of the mechanism which is hydraulically operated, the pedal is fastened to a push rod which in turn is operatively connected to a master cylinder for hydraulic operation of the clutch or brake mechanism. The push rod is typically attached to the pedal at the vehicle assembly location by the use of one or more mechanical fasteners. Attachment of the pedal to the push rod can be cumbersome since the components are connected together beneath the instrument panel where access for assembly is limited. Accordingly, access space for disassembly and servicing of the push rod and pedal assembly in the vehicle is also limited due to the packaging location.

SUMMARY OF THE INVENTION

This invention provides an improved push rod and pedal assembly which offers advantages and alternatives over the prior art. The push rod and pedal assembly provides for ease of assembly of the pedal to other vehicle components, such as a push rod for a master cylinder. The push rod and pedal assembly provides for ease of assembly and disassembly by snap-fitted attachment without the use of traditional mechanical fasteners. Advantageously, the directional orientation and movement of the pedal enables easy attachment of the pedal to the push rod without an operator having to manually reach down underneath the pedal.

These advantages and alternatives are accomplished by providing a push rod and pedal assembly including a pedal pivotally mounted on the vehicle for movement in a generally longitudinal direction and a socket portion mounted on the pedal and movable with the pedal. The socket portion preferably has an opening facing in a generally forward longitudinal direction. The push rod and pedal assembly further includes a longitudinally oriented push rod having a push rod end being alignable generally forward of the socket portion and insertable within the socket portion upon forward longitudinal movement of the pedal. Thus, the push rod end becomes coupled to the socket portion of the pedal upon the application of forward longitudinal movement to the pedal, such as by a foot of an assembler. Preferably, a retainer is mounted on the push rod end and the retainer and push rod end are insertable within the socket portion of the pedal by snap-fitted connection upon forward longitudinal movement of the pedal. Preferably, the push rod end is rotatable relative to the retainer and socket portion.

According to other preferred aspects of the invention, the retainer includes at least one resilient deflectable leg portion including an annular shoulder portion thereon for snap-fitted engagement with the socket portion. In addition, the socket portion includes a collar portion having a rear face for snap-fitted engagement with the annular shoulder portion of the retainer to axially retain the retainer and push rod end in the socket portion. Also preferably, the push rod and pedal assembly includes a circumferentially deflectable removal ring surrounding the leg portions of the retainer and the removal ring is circumferentially compressible for compressing the leg portions to enable removal of the retainer and push rod end from the socket portion. The socket portion of the pedal may include a conical surface sized and shaped for receiving the push rod end thereon.

The invention also further provides a method of easily assembling a pedal pivotally mounted on a vehicle to a push rod end of a master cylinder. The pedal is movable in a generally longitudinal direction and includes a socket portion including an opening facing in a generally longitudinal direction. The vehicle includes a push rod having a push rod end. The push rod is attached to the vehicle such that the push rod end loosely engages the socket portion and lifts the pedal to an uncoupled position in which the push rod end is located generally outside the socket portion of the pedal. Next, the pedal is easily pressed, such as by a foot of an assembler, to move the pedal in a generally longitudinal direction towards the push rod end such that the push rod end is snapped into the socket portion to complete the assembly.

BRIEF DESCRIPTION OF THE DRAWINGS

The present invention will now be described, by way of example, with reference to the accompanying drawings in which:

FIG. 1 is a side view of a push rod and pedal assembly with a clutch pedal shown uncoupled to a master cylinder push rod in solid lines and shown coupled to the push rod in phantom lines;

FIG. 2 is an enlarged perspective view showing the push rod and a retainer prior to coupling to the clutch pedal;

FIG. 3 shows an enlarged perspective view of the push rod coupled to the clutch pedal;

FIG. 4 shows a sectional view taken along line 4—4 of FIG. 3;

FIG. 5 shows an alternate embodiment of the retainer having an integral removal ring;

FIG. 6 shows a sectional view similar to that of FIG. 4, but including the retainer of FIG. 5.

DESCRIPTION OF THE PREFERRED EMBODIMENT

Figure 7:
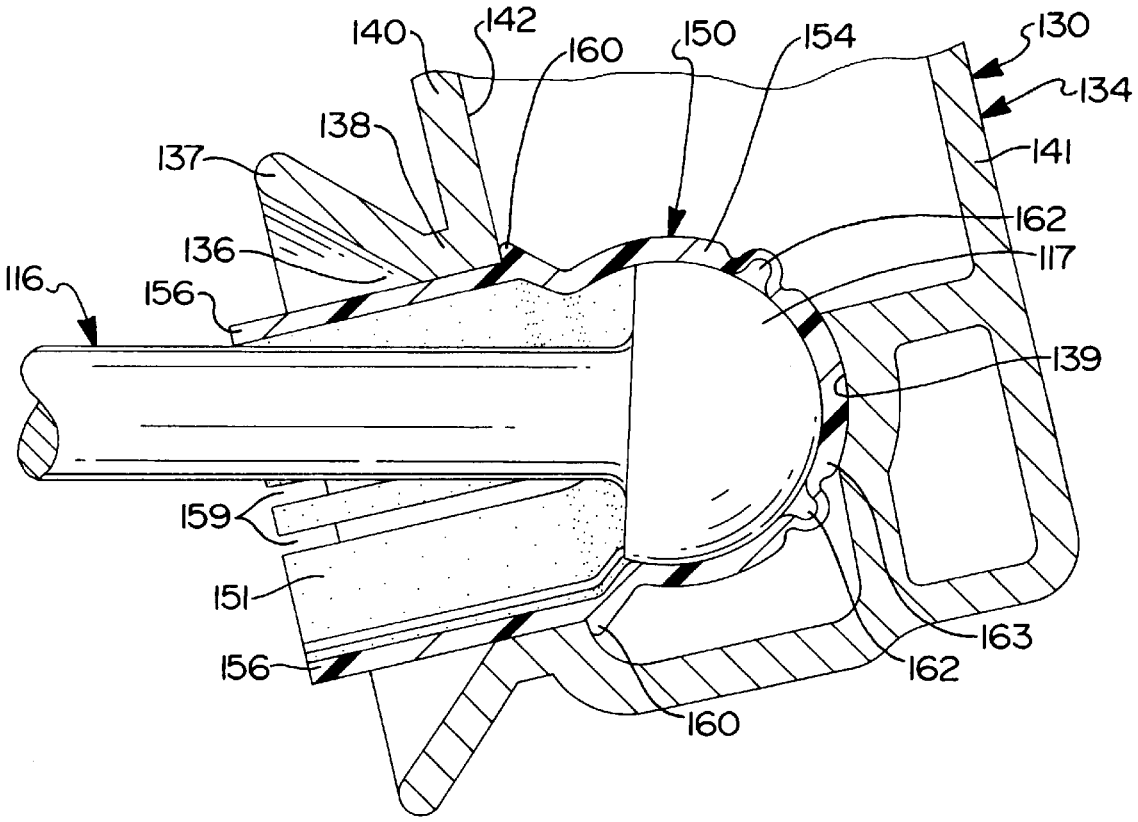
FIG. 7 shows another alternate embodiment of the invention.

A vehicle includes a push rod and pedal assembly, generally designated as 10. The push rod and pedal assembly 10 is mounted to the vehicle forward of a vehicle driver (not shown) at a location under the instrument panel (not shown) at the lower dash panel 11. The push rod and pedal assembly 10 is operable by application and release of pressure from the driver's foot on a foot contact portion 32 of the pedal 30. The push rod and pedal assembly 10 as shown is preferably a clutch pedal assembly 10, however, it will be appreciated that the assembly 10 could alternately be any type of push rod and pedal assembly, such as for a brake pedal. The clutch push rod and pedal assembly 10 is particularly useful in vehicles having manual transmissions for disengaging a clutch mechanism (not shown) when changing gears.

The push rod and pedal assembly 10 is preferably hydraulically operated and includes a clutch master cylinder assembly 20 including a forwardmost clutch master cylinder 12 connected to a neutral start and cruise switch 14 which in turn is connected to a shaft portion 18 of a clutch master cylinder push rod 16 preferably positioned rearward of the switch 14. The push rod 16 has a rearwardmost push rod end 17 connected to the pedal 30, as described hereinafter in detail. The push rod 16 is preferably made of a sturdy, rigid material, such as metal or plastic. The push rod end 17 preferably has a generally spherical shape for permitting rotational movement of the pedal 30 relative to the push rod end 17. During normal vehicle operation, the pedal 30 is pivoted downward and forward along a generally longitudinal line of action so that the push rod 16 is moved generally forward and provides fluid pressure for disengaging the clutch mechanism which is connected to the master cylinder 12 by a fluid line (not shown). The push rod and pedal assembly 10 further includes a retainer 50 and a removal ring 52 mounted on the push rod end 17 which assist with connection of the push rod end 17 to the pedal 30, as described further hereinafter.

Referring to FIGS. 1–4, the clutch pedal 30 is preferably integrally molded from a plastic material. The pedal 30 preferably has a partially hollow box-like cross-section with reinforcement ribs such that it provides a lightweight, yet sturdy pedal 30. The pedal 30 is pivotally connected to the vehicle in any suitable manner. The pedal 30 may be pivotally connected to a pedal bracket 28 made of a plastic material. The pedal 30 pivots about a laterally oriented pivot axis A on the pedal bracket 28. The pedal 30 includes the foot contact portion 32 on which a vehicle driver applies pressure during operation of the push rod and pedal assembly 10. The pedal 30 moves forward and rearward as it pivots about the axis A and moves generally along a longitudinal line of motion which is generally perpendicular to the pivot axis A. The pedal 30 is shown in its normal assembled position with the clutch mechanism engaged in phantom lines in FIG. 1. To disengage the clutch mechanism for changing gears, the pedal 30 is moved forward and downward from the phantom line position by the driver's foot.

As best shown in FIGS. 3 and 4, the pedal 30 includes a socket portion 34 having an entry hole 36 for receiving the push rod end 17 of the push rod 16 therein. As best shown in FIG. 1, the entry hole 36 faces generally in the forward longitudinal direction and is surrounded by a cone-like tapered flange 37 for guiding the push rod end 17 and the retainer 50 into the entry hole 36 of the socket portion 34, as described further hereinafter. The socket portion 34 is generally sized and shaped for receiving the retainer 50 and push rod end 17 therein by snap-fitted connection, as described below.

As best shown in FIG. 4, the socket portion 34 preferably includes a vertical forward wall 40 on which the entry hole 36 is positioned and a vertical rearward wall 41 spaced behind the forward wall 40. The socket portion 34 further includes a reduced diameter collar portion 38 located on the forward wall 40 and surrounding the entry hole 36 for closely engaging the retainer 50 upon assembly, as described further hereinafter. The socket portion 34 also preferably includes a conical surface 39 located on or near the rearward wall 41 and generally axially aligned with the entry hole 36. The conical surface 39 preferably has a mating concave shape for rotatably seating the retainer 50 and the push rod end 17 therein when the push rod 16 and retainer 50 are assembled within the socket portion 34 of the pedal 30. It will be appreciated that the pedal 30 including the socket portion 34 are preferably integrally molded as a single component for reduction of parts.

As best shown in FIG. 2, the retainer 50 is preferably integrally molded from a plastic material. The retainer 50 preferably includes a generally spherical head portion 54 sized and shaped for closely receiving the push rod end 17 therein such that the head portion 54 of the retainer 50 is freely rotatable relative to the push rod end 17. As best shown in FIGS. 2 and 3, the retainer 50 also preferably includes a plurality of resiliently deflectable first leg portions 56 and a plurality of resiliently deflectable second leg portions 57 extending axially from the head portion 54. Preferably, the first and second leg portions 56, 57 are alternately located about the circumference of the retainer 50 with slots 59 located between the first and second leg portions 56, 57. The first and second leg portions 56, 57 each terminate in a generally forward direction to form a retainer opening 51 through which the push rod end 17 is inserted prior to assembly to the pedal 30. The forwardmost ends of the first and second leg portions 56, 57 each preferably include a radially outwardly projecting lip portion 58 to assist with holding the removal ring 52 on the retainer 50, as described further hereinafter.

As best shown in FIG. 2, the first leg portions 56 are preferably wider than the second leg portions 57. The first leg portions 56 preferably each include an intermediate shoulder portion 60 projecting radially outward from the first leg portions 56. As best shown in FIG. 4, the shoulder portions 60 enable the first leg portions 56 to be deflected inwardly through the entry hole 36 for snap-fitted engagement with a rear face 42 of the collar portion 38 of the socket portion 34 to hold the retainer 50 and the push rod end 17 axially within the socket portion 34. The second leg portions 57 preferably do not include an outwardly projecting intermediate shoulder portion and are normally biased slightly radially outward when the removal ring 52 is attached such that the second leg portions 57 remain positioned further radially outward from the first leg portions 56 upon insertion within the socket portion 34 to provide continued retention of the removal ring 52 to the retainer 50 during assembly to the pedal 30.

As best shown in FIGS. 2, 3, and 4, the removal ring 52 preferably has a generally cylindrical hoop-like wire body 84 which is sized and shaped for closely receiving the first and second leg portions 56, 57 therein and for normally applying a slight compressive load on the leg portions 56, 57. When the removal ring 52 is attached to the retainer 50, the second leg portions 57 are preferably slightly outwardly biased against the removal ring 52 to hold the removal ring 52 onto the retainer 50 in addition to axial retention of the removal ring 52 by the lip portions 58 on the leg portions 56, 57. The removal ring 52 further includes first and second end tabs 85 which are normally circumferentially spaced apart to provide a circumferential gap 86 therebetween when the retainer 50 and push rod end 17 are in the assembled condition and when the removal ring 52 is in an uncompressed condition. The end tabs 85 on the removal ring 52 can be circumferentially compressed together to decrease the gap 86 and the diameter of the retainer ring 50 and accordingly decrease the diameter of the first and second leg portion 56, 57 such that the retainer 50 and push rod 16 can be easily removed from the socket portion 34, as described further hereinafter.

The push rod and pedal assembly 10 is easily assembled as follows. The pedal 30 is pivotally connected to the vehicle such as at the pedal bracket 28 in an appropriate manner. Preferably prior to attachment of the push rod 16 to the master cylinder 12 and prior to attachment of the push rod end 17 to the pedal 30, the retainer 50 is easily mounted on the push rod end 17 simply by inserting the generally spherical push rod end 17 through the retainer opening 51 such that the push rod end 17 is seated in the head portion 54 of the retainer 50. This is enabled by the resilient outward radial deflection of the leg portions 56, 57 of the retainer 50. It will be appreciated that either prior to or after attachment of the retainer 50 to the push rod end 17, the removal ring 52 is attached to the retainer 50 by any combination of radial expansion of the resiliently deflectable removal ring 52 and radial contraction of the retainer 50 including the resiliently deflectable first and second leg portions 56, 57. When the removal ring 52 is assembled to the retainer 50, the second leg portions 57 are preferably biased slightly outward against the removal ring 52 to hold the removal ring 52 in position on the retainer 50. In addition, the removal ring 52 is also seated on the retainer 50 just rearward of the lip portions 58 and is axially retained on the retainer 50 by the lip portions 58. The master cylinder assembly 20 is provided in the vehicle including the clutch master cylinder 12, the switch 14, the push rod 16 and the retainer 50 and removal ring 52. The push rod 16 is inserted through the lower dash panel 11 and mounted to the pedal bracket 28 or other vehicle structure, such as by a twist-fitted connection or by traditional fasteners.

As best shown in FIG. 1 in solid lines and in FIG. 2, after attachment of the master cylinder assembly 20 to the vehicle, including the attachment of the push rod end 17 within the retainer 50, the push rod shaft portion 18 extends forward of the lower dash panel 11 and is in a generally rigid condition reacting against the fluids of the hydraulic clutch assembly. In addition, the pedal 30 is pivotally connected to the vehicle in an appropriate manner. As shown in FIGS. 1 and 2, the push rod 16 lifts the pedal 30 to an uncoupled position in which the push rod end 17 is not yet inserted into the socket portion 34 of the pedal 30, but is generally aligned therewith and loosely held in the cone-like tapered flange 37. It will be appreciated that in the uncoupled position, gravity forces the cone-like tapered flange 37 of the socket portion 34 towards alignment with the push rod end 17. This is facilitated by the fact that the entry hole 36 for the socket portion 34 faces in a forwardly direction and is generally perpendicular to the pivotal axis of the pedal 30. In addition, the socket portion 34 and the entry hole 36 have the same directional orientation as the generally longitudinal line of motion of the pedal 30 and the generally longitudinal line of motion of the push rod 16.

The pedal 30 can be easily coupled to the push rod to complete the push rod and pedal assembly 10 as follows. As best shown in FIGS. 1 and 2, the pedal 30 is initially in the uncoupled position as it was lifted by the push rod 16 with the head portion 54 of the retainer 50 and the push rod end 17 generally captured within the cone-shaped tapered flange 37 by gravitational forces. To couple the pedal 30 to the push rod 16 and retainer 50, the operator simply pushes on the foot contact portion 32 of the pedal 30. This causes the pedal 30 to pivot generally forward and downward such that the head portion 54 of the retainer 50 with the push rod end 17 therein is guided through the entry hole 36 and past the collar portion 38 for snap-fitted connection with the socket portion 34. As the retainer 50 is pushed through the entry hole 36, the annular shoulder portions 60 on the first leg portions 56 are deflected inwardly as they pass through the collar portion 38 past the forward wall 40 and then resiliently deflect outward after passing the collar portion 38 for snap-fitted engagement therewith. The shoulder portions 60 of the retainer 50 snap-fittedly engage with the rear face 42 of the collar portion 38 after the head portion 54 of the retainer 50 and the push rod end 17 pass through the collar portion 38. Thus, engagement of the shoulder portions 60 with the collar portion 38 prevents removal of the retainer 50 and push rod end 17 from the socket portion 34 during normal vehicle use. As best shown in FIG. 4, the head portion 54 of the retainer 50 also simultaneously engages the conical surface 39 of the socket portion 34 as the retainer 50 is snap-fit into place behind the collar portion 38. It will be appreciated that engagement of the shoulder portions 60 with the collar portion 38 holds the retainer 50 and also the push rod end 17 in connection with the socket portion 34 of the pedal 30. Advantageously, as the retainer 50 is pushed through the collar portion 38, the second leg portions 57 which do not have an annular shoulder portion remain biased radially outward for continuous retention of the removal ring 52 on the retainer 50. In addition, the lip portions 58 axially retain the removal ring 52 on the retainer 50 during normal vehicle use.

Referring to FIG. 4, it is seen that in the fully assembled condition, the push rod end 17 is coupled to the pedal 30 via snap-fitted connection of the retainer 50 with the socket portion 34 of the pedal 30. FIG. 1 shows the pedal 30 in the coupled position in phantom lines. It will be appreciated that while pressing the pedal 30 during normal operation to engage and disengage the clutch master cylinder assembly 20, the retainer 50 and the socket portion 34 are free to rotate relative to the push rod end 17 as the pedal 30 is pivoted as best shown in FIG. 4. In this manner, the push rod 16 is moved in a longitudinal direction by the pedal 30 which is rotated about the pivot axis A. This is further accomplished by the push rod 16 having a generally longitudinal line of motion and by the socket portion 34 having a generally forward facing entry hole 36 which is generally perpendicular to the pivot axis A.

The push rod end 17 is easily disassembled from the socket portion 34 of the pedal 30 as follows. The end tabs 85 of the removal ring 52 can be squeezed together to reduce the circumferential gap 86 between them such that diameter of the first and second leg portions 56, 57 are simultaneously reduced enough for removal of the annular shoulder portions 60 out through the entry hole 36 of the collar portion 38. Then the retainer 50 and push rod end 17 can be easily axially removed from the socket portion 34.

It will be understood that a person skilled in the art may make modifications to the preferred embodiment shown herein within the scope and intent of the claims. For example, although the socket portion 34 is shown integrally formed with the pedal 30, the socket portion 34 could also be attached to the pedal 30. It will further be appreciated that the socket portion 34 and the push rod 16 could be positioned directly forward of the pedal 30 or slightly laterally offset from the pedal 30 while still utilizing the same advantageous assembly technique. It will further be appreciated that the socket portion 34 could have any shape that is complementary for holding the retainer 50 and push rod end 17 therein.

As another example, FIGS. 5 and 6 shown an alternate embodiment of the invention which is similar to that of FIGS. 1 through 4, but has a removal ring 52' which is integral with the retainer 50'. Similar components are denoted with similar numerals having a prime added.

As best shown in FIG. 5, the retainer 50' includes a head portion 54' and a plurality of leg portions 56' extending axially from the head portion 54'. The leg portions 56' are resiliently deflectable and are integrally molded with retainer 50' from a plastic material. Each of the leg portions 56' is generally of equal width and each includes an annular shoulder portion 60' projecting radially outward from an intermediate section of the leg portions 56'. The removal ring 52' is also integrally molded onto one of the forward ends of the leg portions 56'. The leg portions 56' and the removal ring 52' cooperatively form a retainer opening 51' through which the push rod end 17' of the push rod 16' is inserted. Since the removal ring 52' is integrally molded with the retainer 50', the removal ring 52' remains attached to the retainer 50' during assembly. The removal ring 52' further includes first and second end tabs 85' which are normally circumferentially spaced apart to provide a circumferential gap 86' therebetween when the retainer 50' and push rod end 17' are in the assembled condition. The end tabs 85' on the removal ring 82' can be circumferentially compressed together to decrease the gap 86' and the diameter of the retainer ring 50' and accordingly decrease the diameter of the leg portions 56' such that the retainer 50' and push rod end 17' can be easily removed from the socket portion 34' of the pedal 30', as described further hereinafter.

As best shown in FIG. 6, the retainer 50' and removal ring 52' are easily mounted on the push rod end 17' simply by inserting the generally spherical push rod end 17' through the retainer opening 51' such that the push rod end 17' is seated in the head portion 54' of the retainer 50'. In the assembled condition, the retainer 50' and socket portion 34' are rotatable relative to the push rod end 17'.

The pedal 30' can be easily coupled to the push rod end 17' as follows. As described with respect to FIG. 1, to couple the pedal 30' to the push rod end 17' and retainer 50', the assembler simply pushes on the foot contact portion 32' of the pedal 30'. This causes the pedal 30' to pivot generally forward and downward such that the head portion 54' of the retainer 50' with the push rod end 17' therein is guided by the tapered flange 37' into the entry hole 36' and past the collar portion 38' into the socket portion 34' for snap-fitted connection therewith. As the retainer 50' is pushed through the entry hole 36', the annular shoulder portions 60' on each of the leg portion 56' are deflected radially inward as they pass through the collar portion 38' and then resiliently deflect radially outward after passing the collar portion 38' for snap-fitted engagement with the collar portion 38'. As best shown in FIG. 6, the shoulder portions 60' of the retainer 50' snap-fittedly engage with the rear face 42' of the collar portion 38' after the head portion 54' of the retainer 50' and the push rod end 17' pass through the collar portion 38'. Thus, engagement of the shoulder portions 60' with the collar portion 38' prevents removal of the retainer 50' and push rod end 17' from the socket portion 34' during normal vehicle use. As best shown in FIG. 6, the head portion 54' of the retainer 50' also simultaneously engages the conical surface 39' of the socket portion 34' as the retainer 50' is snap-fit into place behind the collar portion 38'.

Referring to FIG. 6, it is seen that in the fully assembled condition, the push rod end 17' is coupled to the pedal 30' via snap-fitted connection of the retainer 50' with the socket portion 34' of the pedal 30'. The push rod end 17' is easily disassembled from the pedal 30' as follows. The end tabs 85' of the removal ring 52' can be squeezed together to reduce the circumferential gap 86' between them such that diameter of the leg portions 56' are reduced sufficiently for removal of the annular shoulder portions 60' back out through the entry hole 36' of the collar portion 38'.

As another example, FIG. 7 shows yet another embodiment of the invention in which the removal ring is eliminated and in which the retainer 150 is changed. Similar features are denoted by similar numerals plus 100 added and have a similar description with any variations noted below or in FIG. 7.

The pedal 130 and socket portion 134 are similar to those described above. The pedal 130 includes a socket portion 134 having an entry hole 136 for receiving the push rod end 117 of the push rod 116 therein. The socket portion 134 preferably includes a vertical forward wall 140 on which the entry hole 136 is positioned and a vertical rearward wall 141 spaced behind the forward wall 140. The socket portion 134 further includes a reduced diameter collar portion 138 located on the forward wall 140 and surrounding the entry hole 136 for closely engaging the retainer 150 upon assembly, as described further hereinafter. The socket portion 134 also preferably includes a conical surface 139 located on or near the rearward wall 141 and generally axially aligned with the entry hole 136.

The retainer 150 is preferably integrally molded from a plastic material. The retainer 150 preferably includes a generally spherical head portion 154 sized and shaped for closely receiving the push rod end 117 of the push rod 116 therein such that the head portion 154 of the retainer 150 is rotatable relative to the push rod end 117. Also preferably in this embodiment, the head portion 154 of the retainer 150 includes a thinned portion 162 which is preferably in the form of an annular ring on the head portion 154. The thinned portion 162 defines a spring end 163 on the head portion 154 which thus is resiliently deflectable. Advantageously, the spring end 163 acts as a spring to take up any clearance tolerance variations in the assembly of the retainer 150 into the socket portion 134 and to prevent rattles, as described further below.

As shown in FIG. 7, the retainer 150 also preferably includes a plurality of resiliently deflectable leg portions 156 extending axially from the head portion 154. Preferably, the leg portions 156 are located around the circumference of the retainer 150 with slots 159 located between the leg portions 156. The leg portions 156 may be of equal or unequal widths. The leg portions 156 each terminate in a generally forward direction to form a retainer opening 151 through which the push rod end 117 is inserted. The leg portions 156 in this embodiment are preferably longer than those of the prior embodiment such that they extend out further past the tapered flange 137 of the socket portion 134 and are accessible for disassembly, as described below. It will further be appreciated that although the leg portion 156 are shown as having being generally straight, the leg portions 156 could also include a curvature. In addition, the longer leg portions 156 could also include support ribs or thickened portions (not shown) on the leg portions 156 for added stiffness.

The leg portions 156 preferably each include an intermediate shoulder portion 160 projecting radially outward from the leg portions 156. The shoulder portions 160 enable the leg portions 156 to be deflected inwardly through the entry hole 136 for snap-fitted engagement with a rear face 142 of the collar portion 138 of the socket portion 134 to hold the retainer 150 and the push rod end 117 axially within the socket portion 134.

The push rod 116 and the pedal 130 are easily assembled as follows. The pedal 130 is pivotally connected to the vehicle in an appropriate manner. Prior to attachment of the push rod end 117 to the socket portion 134 of the pedal 130, the retainer 150 is easily mounted on the push rod end 117 simply by inserting the generally spherical push rod end 117 through the retainer opening 151 such that the push rod end 117 is seated in the head portion 154 of the retainer 150. This is enabled by the resilient outward radial deflection of the leg portions 156 of the retainer 150. As described above, the push rod 116 lifts the pedal 130 to an uncoupled position in which the push rod end 117 is not yet inserted into the socket portion 134 of the pedal 130, but is generally aligned therewith and loosely held in the cone-like tapered flange 137.

To couple the pedal 130 to the push rod 116 and retainer 150, the operator simply pushes on the foot contact portion of the pedal 130. This causes the pedal 130 to pivot generally forward and downward such that the head portion 154 of the retainer 150 with the push rod end 117 therein is guided through the entry hole 136 and past the collar portion 138 for snap-fitted connection with the socket portion 134. As the retainer 150 is pushed through the entry hole 136, the annular shoulder portions 160 on the leg portions 156 are deflected inwardly as they pass through the collar portion 138 past the forward wall 140 and then resiliently deflect outward after passing the collar portion 138 for snap-fitted engagement therewith. The shoulder portions 160 of the retainer 150 snap-fittedly engage with the rear face 142 of the collar portion 138 after the head portion 154 of the retainer 150 and the push rod end 117 pass through the collar portion 138. Thus, engagement of the shoulder portions 160 with the collar portion 138 prevents removal of the retainer 150 and push rod end 117 from the socket portion 134 during normal vehicle use.

As shown in FIG. 7, the rear end 163 of the head portion 154 of the retainer 150 also simultaneously engages the conical surface 139 of the socket portion 134 as the retainer 150 is snap-fit into place behind the collar portion 138. The spring end 163 acts like a spring as enabled by the thinned portion 162 in the form of an annular ring on the head portion 154. Advantageously, the spring end 163 of the head portion 154 takes up clearance tolerance variations and prevents rattles.

The push rod end 117 is easily disassembled from the socket portion 134 of the pedal 130 as follows. Since the leg portions 156 of the retainer 150 are longer than in the prior embodiments, the forward ends of the leg portions 156 can be squeezed together either manually or by the use of a tool, such as pliers, such that diameter of the leg portions 156 are sufficiently reduced enough for removal of the annular shoulder portions 160 out through the entry hole 136 of the collar portion 138. Thus, the retainer 150 and push rod end 117 can also be easily axially removed from the socket portion 134 without the use of a removal ring.

While the present invention has been described as carried out in specific embodiments thereof, it is not intended to be limited thereby, but is intended to cover the invention broadly within the scope and spirit of the claims.

What is claimed is:

1. A push rod and pedal assembly comprising:

a pedal pivotally mounted on a vehicle for movement in a generally longitudinal direction;

a socket portion mounted on the pedal and movable therewith, the socket portion having an opening facing in a generally forward longitudinal direction; and a longitudinally oriented push rod having a push rod end, the push rod end being alignable generally forward of the socket portion and insertable within the socket portion upon forward longitudinal movement of the pedal;

whereby upon the application of forward longitudinal movement to the pedal, the push rod end becomes coupled to the socket portion of the pedal;

a retainer mounted on the push rod end, the retainer and the push rod end being insertable within the socket portion of the pedal by snap-fitted connection therewith upon forward longitudinal movement of the pedal and wherein the push rod end is rotatable relative to the retainer and socket portion, the retainer including deflectable leg portions to retain the retainer and the push rod end in the socket portion;

a circumferentially deflectable removal ring surrounding the leg portions of the retainer and wherein the removal ring is circumnferentially compressible for compressing the leg portions to enable removal of the retainer and the push rod end from the socket portion.

2. A push rod and pedal assembly comprising:

a pedal pivotally mounted on a vehicle for movement in a generally longitudinal direction;

a socket portion mounted on the pedals and movable therewith, the socket portion having an opening facing in a generally forward longitudinal direction; and a longitudinally oriented push rod having a push rod end, the push rod end being alignable generally forward of the socket portion and insertable within the socket portion upon forward longitudinal movement of the pedal;

whereby upon the application of forward longitudinal movement to the pedal, the push rod end becomes coupled to the socket portion of the pedal;

a retainer mounted on the push rod end, the retainer and the push rod end being insertable within the socket portion of the pedal by snap-fitted connection therewith upon forward longitudinal movement of the pedal and wherein the push rod end is rotatable relative to the retainer and socket portion, the retainer including deflectable leg portions having annular shoulder portions thereon for snap-fitted engagement with the socket portion to axially retain the retainer and the push rod end in the socket portion.

the assembly including a circumferentially deflectable removal ring surrounding the leg portions of the retainer and wherein the removal ring is circumferentially compressible for compressing the leg portions to enable removal of the retainer and the push rod end from the socket portion.

3. A push rod and pedal assembly comprising:

a pedal pivotally mounted on a vehicle for movement in a generally longitudinal direction;

a socket portion mounted on the pedal and movable therewith the socket portion having an opening facing in a generally forward longitudinal direction; and a longitudinally oriented push rod having a push rod end, the push rod end being alignable generally forward of the socket portion and insertable within the socket portion upon forward longitudinal movement of the pedal;

whereby upon the application of forward longitudinal movement to the pedal, the push rod end becomes coupled to the socket portion of the pedal;

a retainer including a plurality of resiliently deflectable first leg portions each having a radially outward projecting shoulder thereon for snap-fitted engagement with the socket portion and wherein the retainer includes a plurality of resiliently deflectable second leg portions which are normally biased radially outward and wherein the assembly includes a circumferentially deflectable removal ring surrounding the first and second leg portions of the retainer and wherein the removal ring is circumferentially compressible for compressing the leg portions to enable removal of the retainer and the push rod end from the socket portion and wherein the second leg portions radially retain the removal ring on the retainer.

4. The assembly of claim 3 wherein the first and second leg portions each include a radially outwardly projecting lip portion thereon for axially retaining the removal ring on the retainer.

* * * * *